US009676214B2

(12) United States Patent
Supron et al.

(10) Patent No.: US 9,676,214 B2
(45) Date of Patent: Jun. 13, 2017

(54) DOCKING STATION FOR A REMOVABLE PRINTER MECHANISM AND METHODS OF PROVIDING A REMOVABLE PRINTER MECHANISM

(71) Applicant: TransAct Technologies Incorporated, Hamden, CT (US)

(72) Inventors: Steven A. Supron, Ithaca, NY (US); Roger J. Rimbey, Spencer, NY (US)

(73) Assignee: TransAct Technologies Incorporated, Hamden, CT (US)

( * ) Notice: Subject to any disclaimer, the term of this patent is extended or adjusted under 35 U.S.C. 154(b) by 454 days.

(21) Appl. No.: 14/039,030

(22) Filed: Sep. 27, 2013

(65) Prior Publication Data

US 2015/0089807 A1 Apr. 2, 2015

(51) Int. Cl.
*B41J 29/04* (2006.01)
*B41J 29/02* (2006.01)

(52) U.S. Cl.
CPC ..... *B41J 29/04* (2013.01); *B41J 29/02* (2013.01); *Y10T 29/49208* (2015.01)

(58) Field of Classification Search
CPC ..... B41J 29/02; B41J 29/04
USPC ..... 29/876, 592.1, 825; 361/679.1, 600
See application file for complete search history.

(56) References Cited

U.S. PATENT DOCUMENTS 5,092,693 A * 3/1992 Uchimura ..... B41J 25/34 400/175
5,180,236 A * 1/1993 Kitahara ..... B41J 17/22 400/120.16
6,183,274 B1 * 2/2001 Allum ..... H01R 13/447 439/135
7,014,483 B2 * 3/2006 Brooks ..... G06Q 20/387 312/223.1
7,425,050 B2 * 9/2008 Silverbrook ..... B41J 2/17553 347/29
7,758,038 B2 * 7/2010 Silverbrook ..... B65H 3/06 271/10.09
2005/0214054 A1 * 9/2005 Hoshino ..... B41J 3/4075 400/613
2005/0287852 A1 * 12/2005 Sugawara ..... G06F 1/1632 439/135
2007/0286659 A1 * 12/2007 Yamada ..... B41J 2/325 400/58

(Continued)

*Primary Examiner* — Peter DungBa Vo
*Assistant Examiner* — Kaying Kue
(74) *Attorney, Agent, or Firm* — Lipsitz & McAllister, LLC

(57) ABSTRACT

A docking station for a removable printer mechanism is provided, together with methods for providing a removable printer mechanism. The docking station may have a base with parallel side arms adapted to be fixed to an interior of a printer housing. Side walls may extend from each of the parallel side arms. The side walls may be adapted to guide the printer mechanism into a docked position in the printer and to removably fix the printer mechanism in the docked position. A bridge element may extend between the parallel side arms at a rear of the base. A clamping element may be fixed to the bridge element and be adapted to hold a printer-side cable connector in position to accept a corresponding cable connector of the printer mechanism. The printer mechanism may easily be slid into and out of the docking station for repair or replacement.

14 Claims, 5 Drawing Sheets

(56) References Cited

U.S. PATENT DOCUMENTS

| | | | | |
|---|---|---|---|---|
| 2009/0058891 | A1* | 3/2009 | Kershisnik | B41J 3/546<br>347/2 |
| 2012/0069118 | A1* | 3/2012 | Mistyurik | B41J 3/4075<br>347/109 |

* cited by examiner

DOCKING STATION FOR A REMOVABLE PRINTER MECHANISM AND METHODS OF PROVIDING A REMOVABLE PRINTER MECHANISM

BACKGROUND OF THE INVENTION

The present invention relates to the field of printers. More particularly, the present invention relates to a docking station for a printer mechanism of a printer which enables easy removal and replacement of the printer mechanism, and methods for providing a removable printer mechanism.

The printer mechanism tends to be the least reliable element of a printer. In particular, printer mechanisms of high volume printers, such as label printers, point of sale printers, gaming machine printers, and the like have a higher rate of service calls for printer mechanism repair and replacement.

Further, a printer may be part of a larger system that includes multiple printers, paper holders, a power supply and a large display. The print station's reliability (and thus that of the system) may be impacted by contamination of the print head due to adhesive used on the back of labels, preprinting on the surface of labels, or contamination from the environment (e.g., such as a food preparation environment) when loading labels.

Accordingly, it would be advantageous to provide a printer and a corresponding printer mechanism that is adapted for easy removal and replacement, without the need for tools, printer disassembly, or removal of the entire printer for offsite repair. In particular, it would be advantageous to provide a docking station for a printer that accepts a removable printer mechanism which does not require the use of tools for removal.

The docking station of the present invention advantageously allows for easy, tool-free customer removal and replacement of the printer mechanism without the need to return the printer or the larger system for repair. With the present invention, the print mechanism can also be removed to allow easier customer cleaning of the print head.

The methods and apparatus of the present invention provide the foregoing and other advantages.

SUMMARY OF THE INVENTION

The present invention relates to a docking station for a removable printer mechanism and methods of providing such a removable printer mechanism.

In one example embodiment of a docking station for a removable printer mechanism in accordance with the present invention, the docking station may comprise a base with parallel side arms adapted to be fixed to an interior of a printer housing. Side walls may extend from each of the parallel side arms. The side walls may be adapted to guide a printer mechanism into a docked position in the printer and to removably fix the printer mechanism in the docked position. A bridge element may extend between the parallel side arms at a rear side of the base. A clamping element may be fixed to the bridge element and be adapted to receive a printer-side cable connector and to hold the printer-side cable connector in position to accept a corresponding cable connector of the printer mechanism.

A gap may be provided between the bridge element and a floor of the printer housing when the docking station is fixed in the interior of the printer. The gap between the bridge element and the floor of the printer housing may be adapted to accept a tongue of the printer mechanism.

The side walls may each be provided with a slot for accepting alignment studs of the printer mechanism. The alignment studs may snap into detents provided in the slots to removably fix the printer mechanism in the docking station. A connection between the printer-side cable connector and the corresponding cable connector of the printer mechanism may be established as the alignment studs snap into the detents. One of the alignment studs may comprise a mounting location for a transmission gear of the printer mechanism.

The clamping element may removably hold the printer-side cable connector with a snap fit.

The present invention also encompasses methods for providing a removable printer mechanism. In one example embodiment of such a method in accordance with the present invention, the method may comprise providing a docking station for the printer mechanism. The docking station may comprise a base with parallel side arms adapted to be fixed to an interior of a printer housing, side walls which may extend from each of the parallel side arms, the side walls being adapted to guide a printer mechanism into a docked position in the printer and to removably fix the printer mechanism in the docked position, a bridge element which may extend between the parallel side arms at a rear side of the base, and a clamping element which may be fixed to the bridge element and be adapted to receive a printer-side cable connector and to hold the printer-side cable connector in position to accept a corresponding cable connector of the printer mechanism. The method may further comprise providing a removable printer mechanism adapted to be guided by the side walls of the docking station into the docked position, removably fixing the printer mechanism in the docking station in the docked position, and establishing a removable connection between the printer-side cable connector and the corresponding cable connector of the printer mechanism when the printer mechanism is in the docked position.

The method may also include additional features discussed above in connection with the various embodiments of the docking station.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Figure 1:
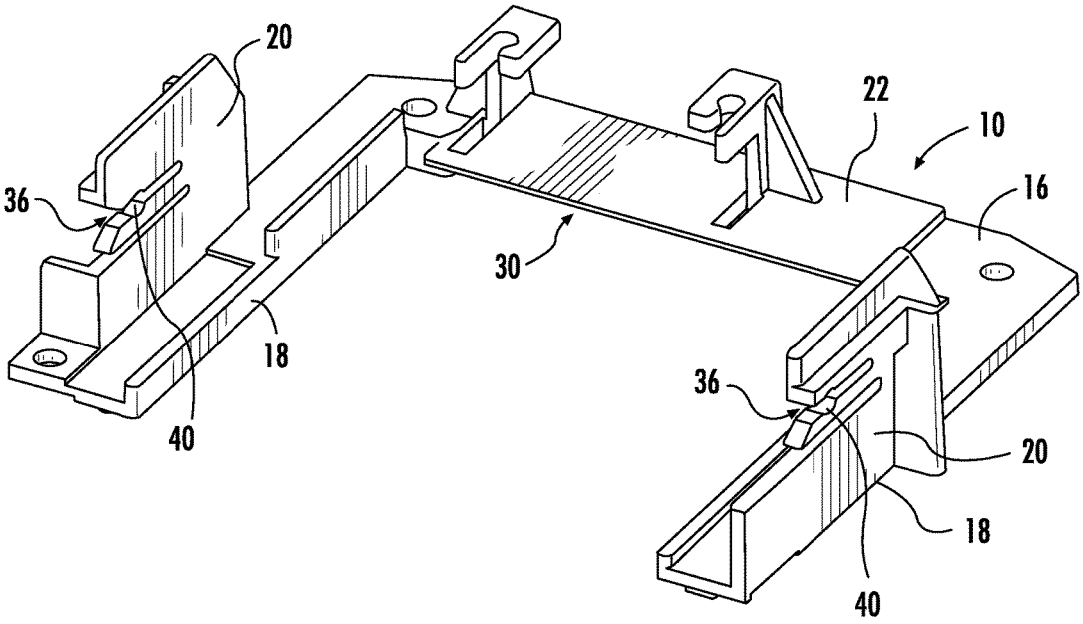
FIG. 1 shows an example embodiment of a docking station for a printer mechanism in accordance with the present invention.
Figure 2:
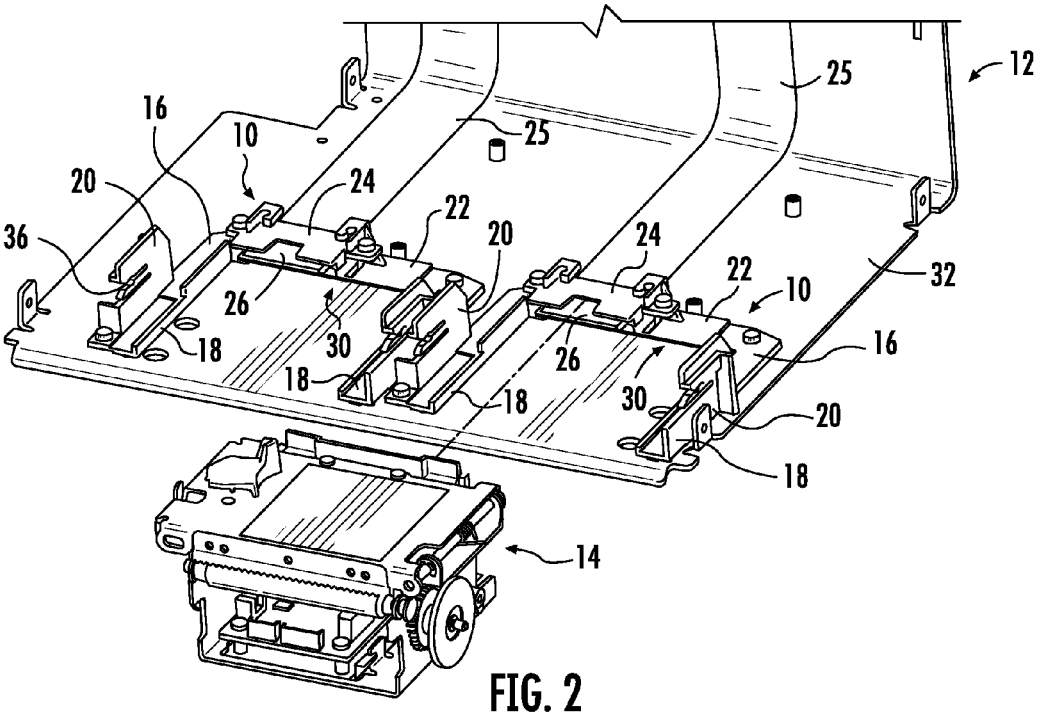
FIG. 2 shows the docking station mounted in a printer housing with a printer mechanism in a removed position in accordance with the present invention.
Figure 3:
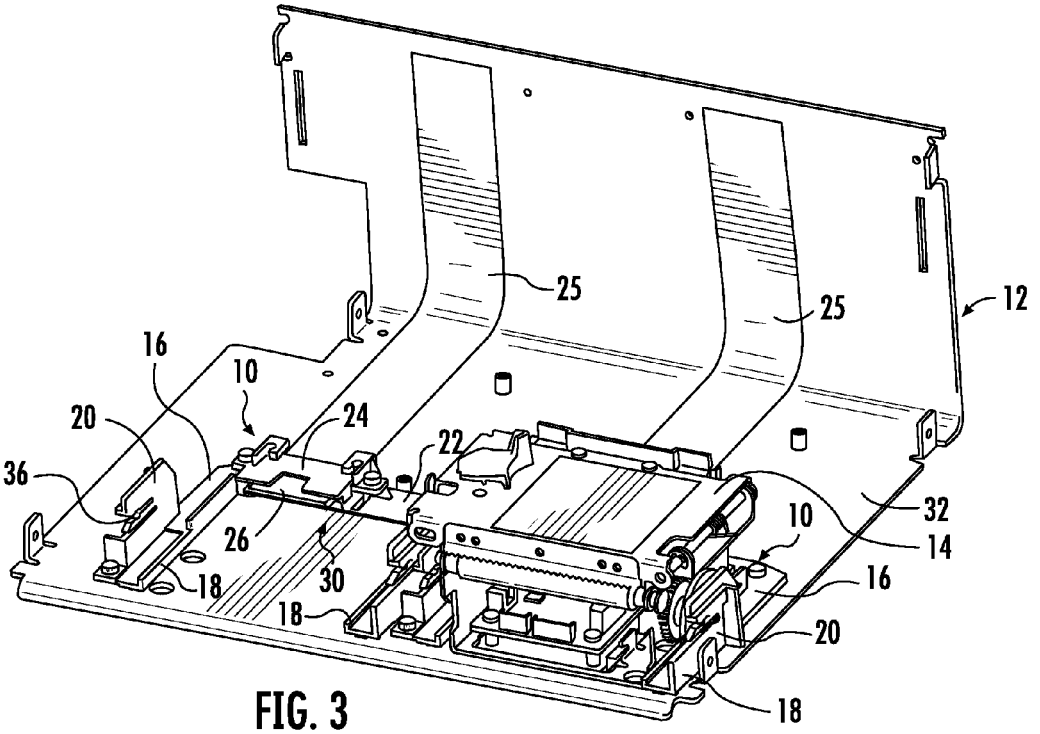
FIG. 3 shows the docking station mounted in a printer housing with a printer mechanism in a docked position in accordance with an example embodiment of the present invention.
Figure 4:
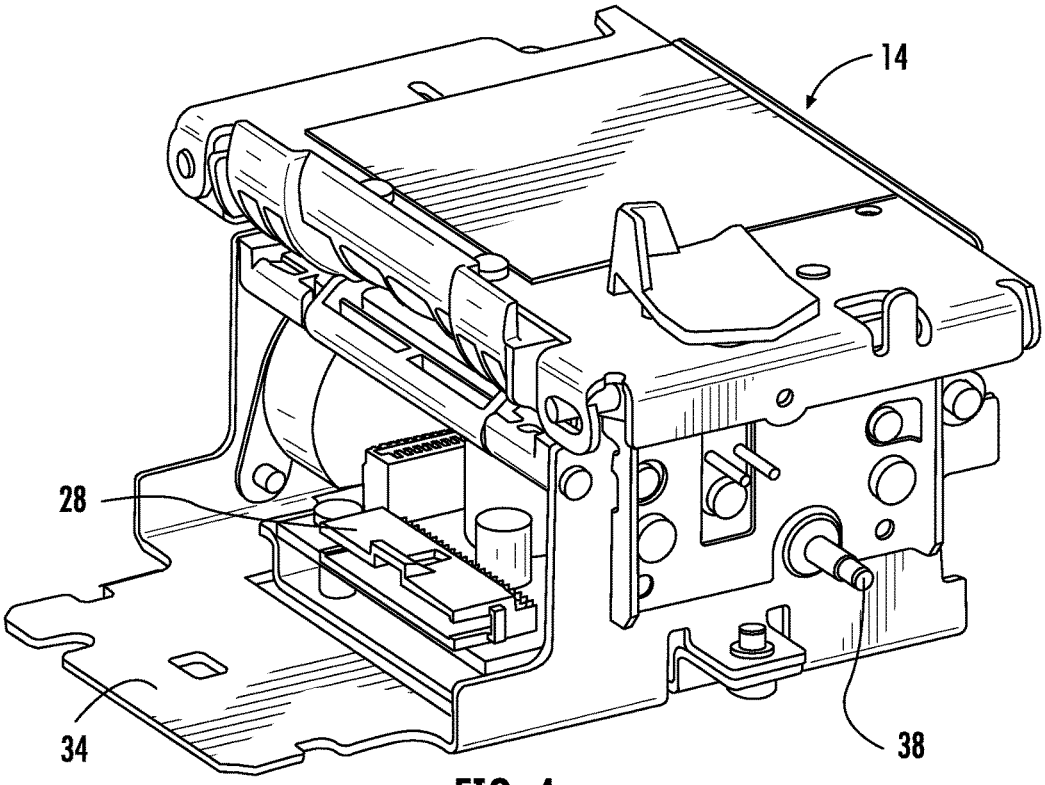
FIG. 4 shows an example embodiment of a printer mechanism in accordance with an example embodiment of the present invention from one side.
Figure 5:
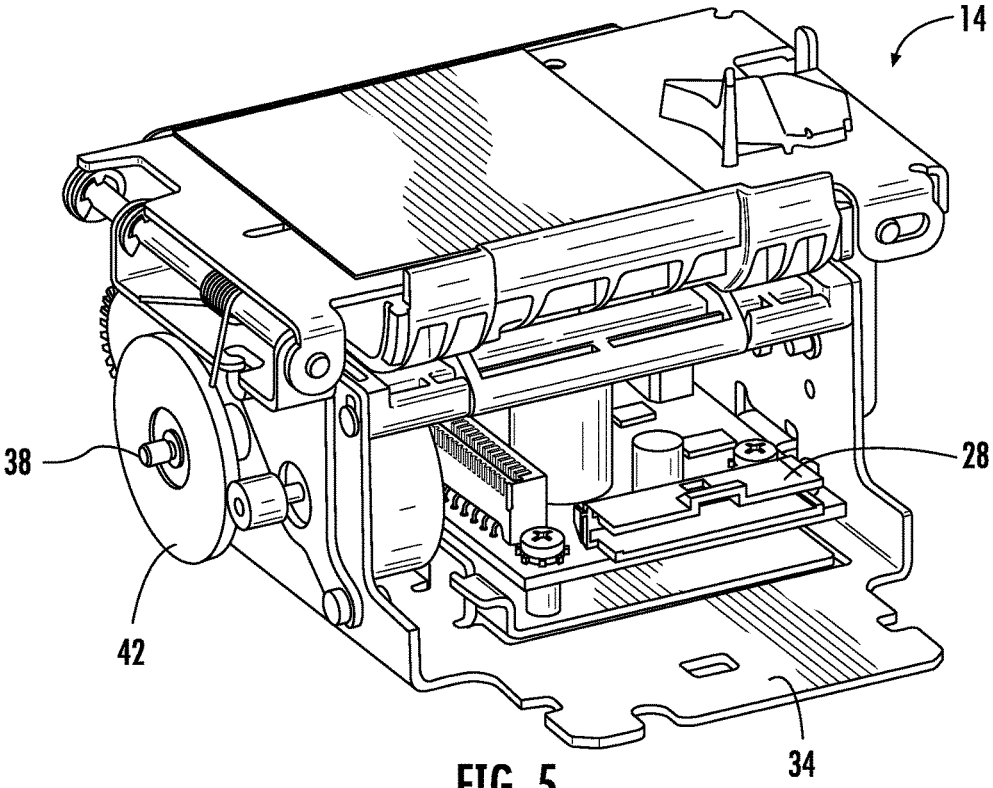
FIG. 5 shows an example embodiment of a printer mechanism in accordance with an example embodiment of the present invention from the other side.

An example embodiment of a docking station 10 for a removable printer mechanism in accordance with the present invention is shown in FIG. 1. FIGS. 2 and 3 show the docking station 10 of FIG. 1 installed in a printer housing 12 (note only a partial assembly of the interior of the printer housing is shown for clarity in FIGS. 2 and 3). In FIG. 2, the printer mechanism 14 is shown in the removed position, and in FIG. 3 the printer mechanism 14 is shown in a docked position in the docking station 10. FIGS. 4 and 5 show opposite sides of an example embodiment of a printer mechanism 14. Although FIGS. 2 and 3 show a printer housing 12 configured with two docking stations 10 to accept two printer mechanisms 14, it should be appreciated that the present invention can be implemented in a printer having only a single docking station 10 and a single printer mechanism 14.

Figure 6:
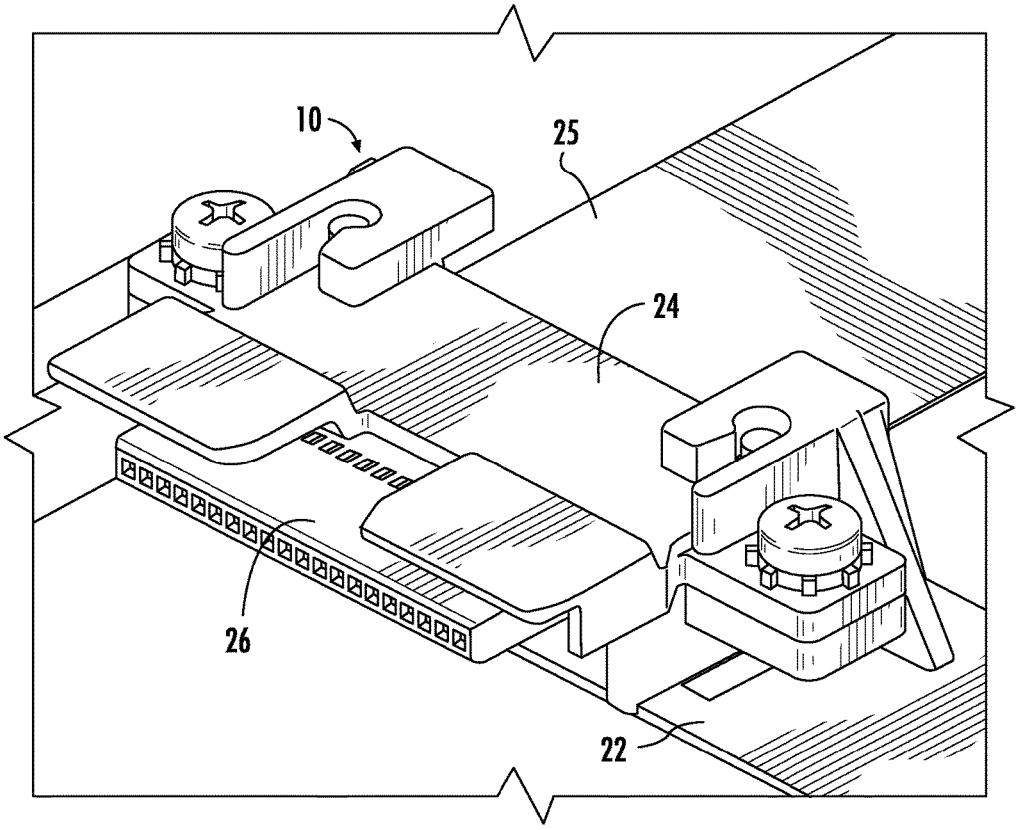
FIG. 6 shows an example embodiment of a clamping element of the docking station in accordance with an example embodiment of the present invention.

The docking station 10 may comprise a base 16 with parallel side arms 18 adapted to be fixed to an interior of a printer housing 12. Side walls 20 may extend from each of the parallel side arms 18. The side walls 20 may be adapted to guide the printer mechanism 14 into a docked position (shown in FIG. 3) in the printer and to removably fix the printer mechanism 14 in the docked position. A bridge element 22 may extend between the parallel side arms 18 at a rear side of the base 16. As shown in FIG. 6, a clamping element 24 may be fixed to the bridge element 22 and be adapted to receive a printer-side cable connector 26. The clamping element 24 may hold the printer-side cable connector 26 in position to accept a corresponding cable connector 28 (shown in FIG. 4) of the printer mechanism 14. The clamping element 24 may be a clamp for an FCC cable connector of an FCC cable 25, as shown in the Figures. However, the present invention may be easily modified to use other types of clamps for other types of cable connectors, the important aspect being the positioning of the printer-side cable connector at a location (height and position between side walls 20) to automatically mate with the corresponding printer mechanism cable connector upon insertion of the printer mechanism 14 into the docking station 10.

A gap 30 may be provided between the bridge element 22 and a floor 32 of the printer housing 12 when the docking station 10 is fixed in the interior of the printer. The gap 30 between the bridge element 22 and the floor 32 of the printer housing 12 may be adapted to accept a tongue 34 of the printer mechanism 14. The tongue 34 of the printer mechanism may be provided to assist in guidance of the printer mechanism 14 into the docked position in the docking station 10. In particular, the tongue 34 may slide into the gap 30 under the bridge element 22 when the printer mechanism 14 is inserted into the docking station 10.

Figure 7:
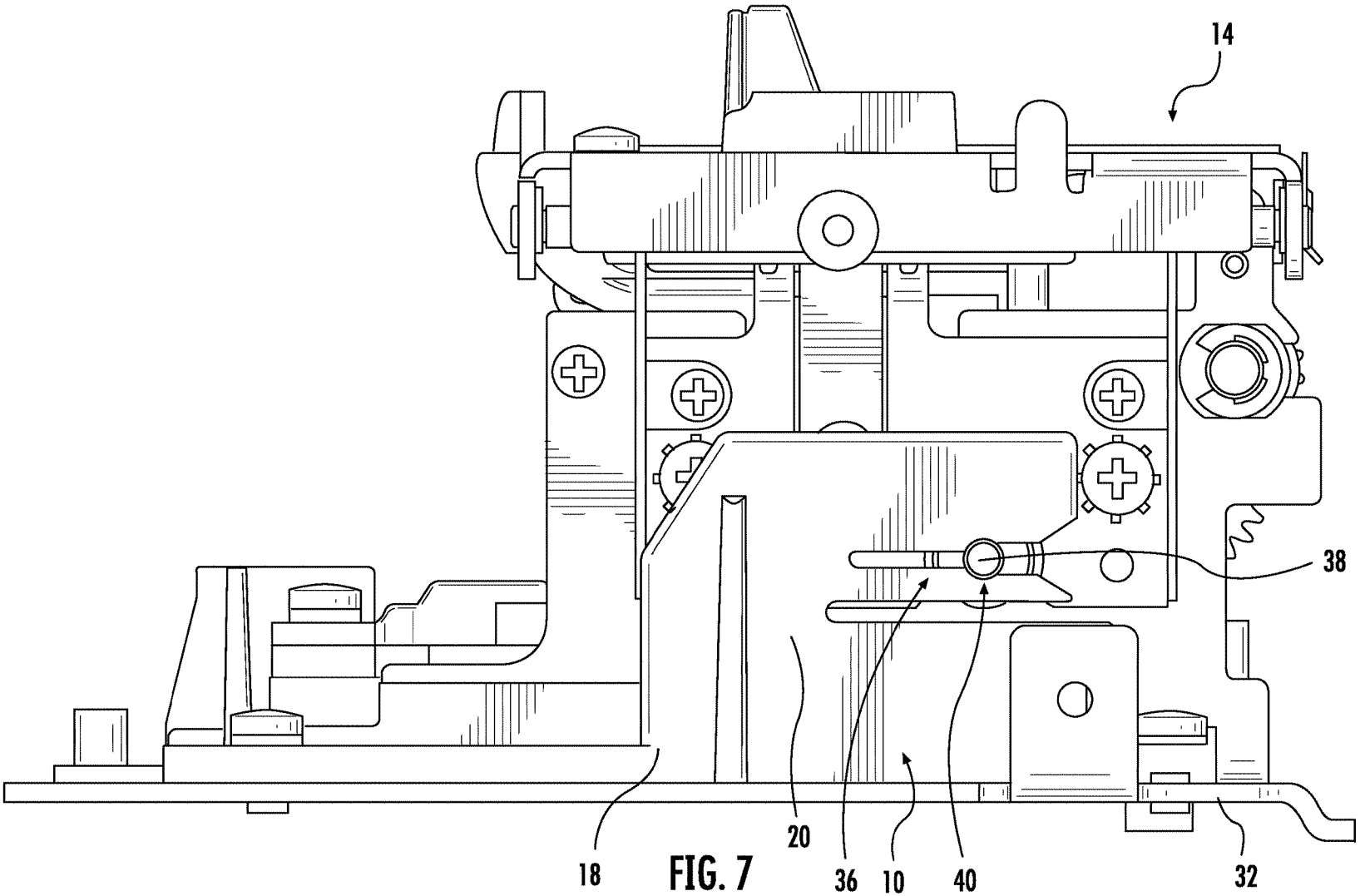
FIG. 7 shows a side view of a printer mechanism in the docked position in the docking station in accordance with an example embodiment of the present invention.

The side walls 20 may each be provided with a slot 36 for accepting alignment studs 38 of the printer mechanism (see FIGS. 4 and 5). As shown in FIG. 7, the alignment studs 38 may snap into detents 40 provided in the slots 36 to removably fix the printer mechanism 14 in the docking station 10. A connection between the printer-side cable connector 26 and the corresponding cable connector 28 of the printer mechanism 14 may be established as the alignment studs 38 snap into the detents 40. One of the alignment studs 38 may comprise a mounting location for a transmission gear 42 of the printer mechanism 14.

The clamping element 24 may removably hold the printer-side cable connector 26 with a snap fit. The clamping element 24 may be a plastic clamp which is flexibly mounted to the bridge element 22 by a snap fit and/or screws.

With the docking station 10 of the present invention, the printer mechanism 14 can be easily removed from or installed in the printer by a user with a one hand and without the use of tools. Installation or insertion of the printer mechanism 14 is accomplished by opening a front door or cover of the printer and simply sliding the printer mechanism 14 into the docking station 10. The side walls 20 of the docking station 10 align the printer mechanism cable connector 28 with the printer-side cable connection 26. The printer mechanism 14 snaps into place in the docking station 10 as the electrical connection between connectors 26 and 28 is made. Removal of the printer mechanism 14 is simply the reverse of the installation procedure. The printer mechanism 14 is simply pulled out of the docking station 10 with sufficient force to overcome a holding force of the detents 40 which retain the alignment studs 38 in the slots 36 of the side walls 20. This ease of insertion and removal allows the printer mechanism 14 to be removed for repair without returning the entire printer assembly, or to be easily replaced.

The present invention also encompasses methods for providing a removable printer mechanism. In one example embodiment of such a method in accordance with the present invention, the method may comprise providing a docking station 10 for the printer mechanism 14. The docking station 10 may comprise a base 16 with parallel side arms 18 adapted to be fixed to an interior of a printer housing 12, side walls 20 which may extend from each of the parallel side arms 18, the side walls 20 being adapted to guide a printer mechanism 14 into a docked position in the printer and to removably fix the printer mechanism 14 in the docked position, a bridge element 22 which may extend between the parallel side arms 18 at a rear side of the base 16, and a clamping element 24 which may be fixed to the bridge element 22 and adapted to receive a printer-side cable connector 26. The clamping element 24 may hold the printer-side cable connector 26 in position to accept a corresponding cable connector 28 of the printer mechanism 14. The method may further comprise providing a removable printer mechanism 14 adapted to be guided by the side walls 20 of the docking station 10 into the docked position, removably fixing the printer mechanism 14 in the docking station 10 in the docked position, and establishing a removable connection between the printer-side cable connector 26 and the corresponding cable connector 28 of the printer mechanism 14 when the printer mechanism 14 is in the docked position.

The method may also include additional features discussed above in connection with the various embodiments of the docking station 10.

It should now be appreciated that the present invention provides an advantageous docking station for a removable printer mechanism and methods of providing such a removable printer mechanism.

Although the invention has been described in connection with various illustrated embodiments, numerous modifications and adaptations may be made thereto without departing from the spirit and scope of the invention as set forth in the claims.

What is claimed is:

1. A docking station for a removable ink-free printer mechanism, comprising:

a base with parallel side arms adapted to be fixed to an interior floor of a printer housing;

a side wall extending vertically from each of the parallel side arms, the side walls being adapted to guide a printer mechanism into a docked position in the printer, each of the side walls being provided with a slot for accepting alignment studs of the printer mechanism, each of the slots being provided with a detent for retaining the alignment studs to removably fix the printer mechanism in the docked position;

a bridge element extending between the parallel side arms at a rear side of the base;

a clamping element fixed to the bridge element adapted for clamping and holding a printer-side cable connector in position to accept a corresponding cable connector of the printer mechanism.

2. A docking station in accordance with claim 1, wherein a gap is provided between the bridge element and the interior floor of the printer housing when the docking station is fixed in the interior of the printer.

3. A docking station in accordance with claim 2, wherein the gap between the bridge element and the interior floor of the printer housing is adapted to accept a tongue of the printer mechanism.

4. A docking station in accordance with claim 1, wherein a connection between the printer-side cable connector and the corresponding cable connector of the printer mechanism is established as the alignment studs snap into the detents.

5. A docking station in accordance with claim 1, wherein one of the alignment studs comprises a mounting location for a transmission gear of the printer mechanism.

6. A docking station in accordance with claim 1, wherein the clamping element removably holds the printer-side cable connector with a snap fit.

7. A method for providing a removable printer mechanism, comprising:

providing a docking station for the printer mechanism, the docking station comprising:

a base with parallel side arms adapted to be fixed to an interior of a printer housing;

a side wall extending from each of the parallel side arms, the side walls being adapted to guide the printer mechanism into a docked position in the printer;

a bridge element extending between the parallel side arms at a rear side of the base;

a clamping element fixed to the bridge element for clamping and holding a printer-side cable connector in position to accept a corresponding cable connector of the printer mechanism;

providing a removable printer mechanism adapted to be guided by the side walls of the docking station into the docked position;

removably fixing the printer mechanism in the docking station in the docked position;

establishing a removable connection between the printer-side cable connector and the corresponding cable connector of the printer mechanism when the printer mechanism is in the docked position;

wherein the printer mechanism comprises an ink-free printer mechanism.

8. A method in accordance with claim 7, further comprising providing a gap between the bridge element and a floor of the printer housing when the docking station is fixed in the interior of the printer.

9. A method in accordance with claim 8, wherein the gap between the bridge element and the floor of the printer housing is adapted to accept a tongue of the printer mechanism.

10. A method in accordance with claim 7, wherein the side walls are each provided with a slot for accepting alignment studs of the printer mechanism.

11. A method in accordance with claim 10, wherein the alignment studs snap into detents provided in the slots to removably fix the printer mechanism in the docking station.

12. A method in accordance with claim 11, wherein the connection between the printer-side cable connector and the corresponding cable connector of the printer mechanism is established as the alignment studs snap into the detents.

13. A method in accordance with claim 10, wherein one of the alignment studs comprises a mounting location for a transmission gear of the printer mechanism.

14. A method in accordance with claim 7, wherein the clamping element removably holds the printer-side cable connector with a snap fit.

* * * * *